US009215943B1

(12) United States Patent
Varghese-Abraham

(10) Patent No.: US 9,215,943 B1
(45) Date of Patent: Dec. 22, 2015

(54) CLOTHING HANGER ACCESSORY

(71) Applicant: Annie Varghese-Abraham, Frisco, TX (US)

(72) Inventor: Annie Varghese-Abraham, Frisco, TX (US)

( * ) Notice: Subject to any disclaimer, the term of this patent is extended or adjusted under 35 U.S.C. 154(b) by 0 days.

(21) Appl. No.: 14/676,521

(22) Filed: Apr. 1, 2015

Related U.S. Application Data

(63) Continuation of application No. 14/642,226, filed on Mar. 9, 2015.

(60) Provisional application No. 62/098,811, filed on Dec. 31, 2014.

(51) Int. Cl.

| | |
|---|---|
| ***A47F 7/02*** | (2006.01) |
| ***A47G 29/00*** | (2006.01) |
| ***A47G 25/16*** | (2006.01) |
| ***A47B 61/00*** | (2006.01) |
| ***A47G 25/28*** | (2006.01) |
| ***A47F 5/00*** | (2006.01) |

(52) U.S. Cl.
CPC ..... *A47G 25/16* (2013.01); *A47B 61/003* (2013.01); *A47F 5/0006* (2013.01); *A47F 7/022* (2013.01); *A47G 25/28* (2013.01)

(58) Field of Classification Search
CPC . A47G 25/00; A47G 2025/025; A47G 25/06; A47G 25/0607; A47G 25/16; A47G 25/0614; A47G 25/0621; A47G 25/28; A47G 25/743; A47G 29/10; A47B 61/003; A47F 5/0884; A47F 7/02; A47F 7/022; A47F 5/0006; A47F 5/0892; A47F 5/08; A47F 5/00; A47C 11/16
USPC ..... 211/85.3, 85.2, 119.009, 113, 119, 211/119.004, 85.9; 206/6.1; D6/323
See application file for complete search history.

(56) References Cited

U.S. PATENT DOCUMENTS

| | | | | | |
|---|---|---|---|---|---|
| D47,123 | S | * | 3/1915 | Stroke | D6/569 |
| 2,077,316 | A | * | 4/1937 | Geib | 211/85.3 |
| 2,113,394 | A | * | 4/1938 | Biri et al. | 223/88 |
| 2,137,268 | A | * | 11/1938 | Clairon | 223/86 |
| 2,250,245 | A | * | 7/1941 | Angove | 223/88 |
| 2,420,742 | A | * | 5/1947 | Erran | 223/88 |
| 3,081,881 | A | * | 3/1963 | Seeger | 211/85.3 |
| 3,138,259 | A | * | 6/1964 | Sitt | 211/85.2 |
| 3,186,609 | A | * | 6/1965 | Patch | 223/88 |
| 3,339,745 | A | * | 9/1967 | Sugerman | 211/85.2 |
| 3,592,343 | A | * | 7/1971 | Swett et al. | 211/123 |
| 3,718,260 | A | * | 2/1973 | Sharp | 211/85.2 |
| D243,055 | S | * | 1/1977 | Blumberg | D6/315 |
| 4,264,013 | A | * | 4/1981 | Vollmer | 211/85.2 |
| D264,911 | S | * | 6/1982 | Annis et al. | D6/514 |
| D276,673 | S | * | 12/1984 | Ritchey | D6/327 |
| 4,487,343 | A | * | 12/1984 | Chen | 223/85 |
| 4,573,585 | A | * | 3/1986 | Frei | 211/85.2 |
| 4,593,812 | A | * | 6/1986 | Dillingham | 206/292 |
| 4,778,088 | A | * | 10/1988 | Miller | 223/91 |
| 4,932,571 | A | * | 6/1990 | Blanchard | 223/89 |
| 4,966,287 | A | * | 10/1990 | Snyder | 211/85.2 |
| D323,755 | S | * | 2/1992 | Harney | D6/513 |
| 5,240,120 | A | * | 8/1993 | McDonough | 211/85.2 |

(Continued)

*Primary Examiner* — Jennifer E Novosad
(74) *Attorney, Agent, or Firm* — James R. Gourley; Carstens & Cahoon, LLP

(57) ABSTRACT

A clothing hanger accessory that allows a user to store clothing accessories, such as necklaces, bracelets, ear rings, finger rings, bangles, wristbands, headbands, scrunchies, etc. in close proximity to clothing garments that, in combination, form an entire clothing outfit.

5 Claims, 4 Drawing Sheets

(56) References Cited

U.S. PATENT DOCUMENTS

| | | | | |
|---|---|---|---|---|
| 5,242,048 | A * | 9/1993 | Ellingsworth et al. | 206/6.1 |
| 5,526,968 | A * | 6/1996 | Larson | 223/88 |
| 6,196,396 | B1 * | 3/2001 | Bennett | 211/85.3 |
| D471,725 | S * | 3/2003 | Bodine | D6/328 |
| 6,776,463 | B2 * | 8/2004 | Simon et al. | 312/204 |
| 7,377,409 | B1 * | 5/2008 | Brown | 223/88 |
| D605,441 | S * | 12/2009 | Lamplugh | D6/514 |
| D659,906 | S * | 5/2012 | Whitman | D28/73 |
| 8,651,291 | B1 * | 2/2014 | Prather | 211/85.2 |
| 2002/0108976 | A1 * | 8/2002 | Carmichael | 223/85 |
| 2003/0222038 | A1 * | 12/2003 | Collier | 211/85.7 |
| 2007/0193969 | A1 * | 8/2007 | Albanese | 211/85.2 |
| 2009/0057166 | A1 * | 3/2009 | Nelson | 206/6.1 |
| 2009/0224009 | A1 * | 9/2009 | Lubow | 223/91 |
| 2013/0299527 | A1 * | 11/2013 | Mazyck | 223/88 |

* cited by examiner

CLOTHING HANGER ACCESSORY

CROSS-REFERENCE TO RELATED APPLICATION

This application claims priority to co-pending U.S. patent application Ser. No. 14/642,226 filed on Mar. 9, 2015 entitled "Clothing Hanger Accessory," which claims priority to U.S. Provisional Patent Application Ser. No. 62/098,811 filed on Dec. 31, 2014 entitled "A clothes hanger accessory for organization and display of respective jewelry for respective clothing on a clothes hanger," the technical disclosures of which are hereby incorporated by reference in their entirety.

BACKGROUND OF THE INVENTION

Technical Field

The present invention relates to an accessory for use with a clothing hanger, and more particularly an accessory that allows for compact storage of garment accessories with an outfit of clothing.

SUMMARY OF THE INVENTION

One embodiment of the invention is a clothing hanger accessory comprising a front face defining a first plane and a back face defining a second plane which is approximately parallel with the first plane; a loop extending approximately perpendicularly from the back face; a first set of apertures extending from the front face to the back face with each aperture of the first set having a first diameter; a second set of apertures extending from the front face to the back face with each aperture of the second set having a second diameter, wherein the first diameter is larger than the second diameter; at least two support members extending from the front face, wherein each support member comprises a first portion that is approximately perpendicular to the front face and a second portion that is approximately parallel with the front face; at least two hooks extending from a bottom end of the clothing hanger accessory, wherein the at least two hooks define a plane that is approximately parallel with the front face and the back face.

In another embodiment, the clothing hanger accessory of any other embodiment or combination of embodiments wherein the first set of apertures is positioned between the support members and the second set of apertures. In still another embodiment, the clothing hanger accessory of any other embodiment or combination of embodiments wherein the second set of apertures is positioned between the first set of apertures and the at least two hooks. In yet another embodiment, the clothing hanger accessory of any other embodiment or combination of embodiments further comprising a plurality of apertures positioned around a periphery of the accessory. In another embodiment, the clothing hanger accessory of any other embodiment or combination of embodiments wherein the loop is configured to have a clothing hanger hook inserted into and through the loop until the clothing hanger accessory engages the clothing hanger hook at its base from which at least two clothing support members extend.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Figure 3:
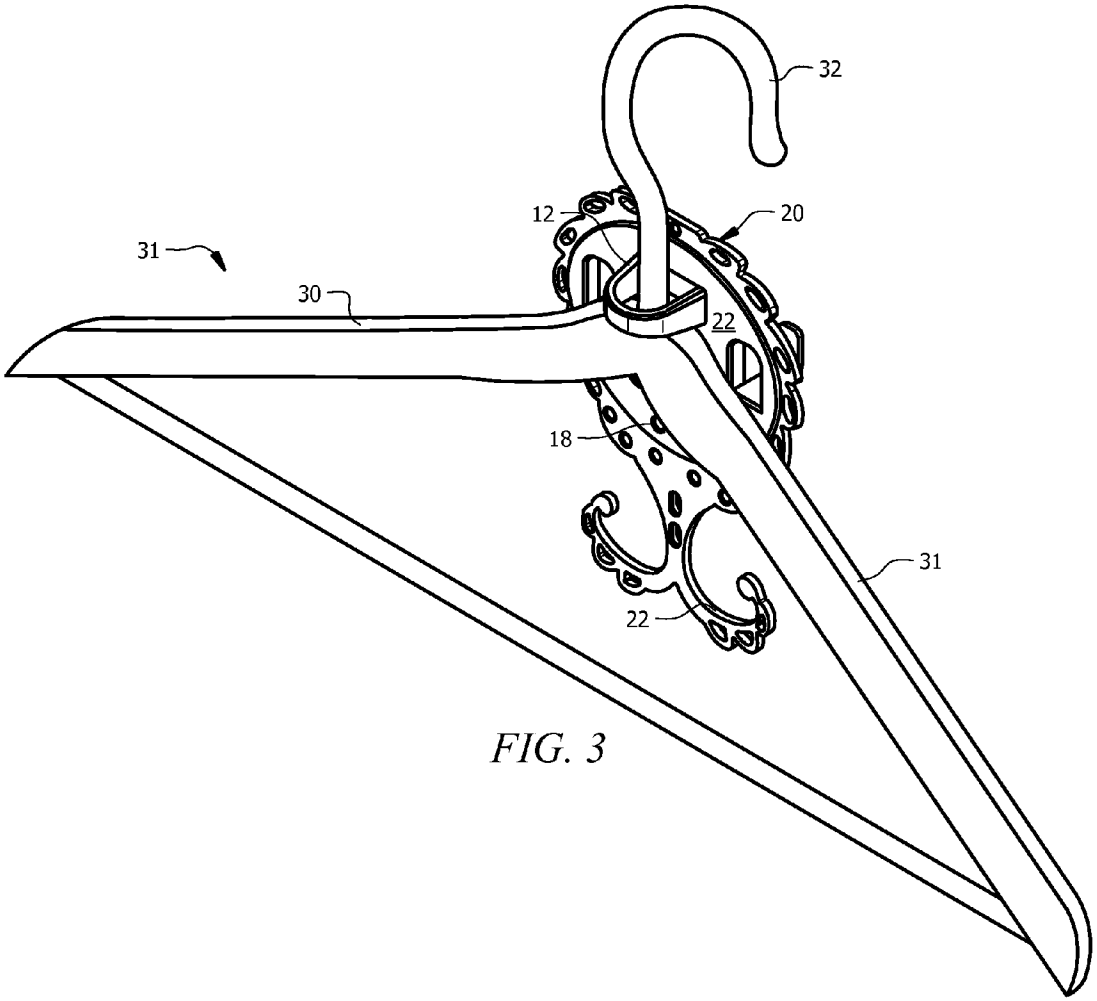
FIG. 3 illustrates a back perspective view of one embodiment of the clothing hanger accessory of the present invention engaged with a clothing hanger.

The clothing hanger accessory of the present invention is intended for use along with a clothing hanger. One example of a clothing hanger is depicted in FIG. 3, referred to generally by reference numeral 31. As depicted therein, a clothing hanger generally comprises a hook 32 (which is used to hang the hanger on a support, such as a bar suspended inside a closet, not shown) attached to at least one clothing support member 30. Preferably, the clothing hanger will comprise two clothing support members 30, each of which extend in generally opposite directions from the base of hook 32.

As depicted in FIG. 3, the clothing hanger accessory 10 of the present invention engages with a clothing hanger 31 by sliding over the hook 32 of the clothing hanger 31 until it engages with clothing support members 30 at the base of the hook 32. In order to effect this engagement, the clothing hanger accessory 10 comprises a loop 12 that extends approximately perpendicularly outward from the back face 22 of the clothing hanger accessory 10. The loop 12 need not be circular, semi-circular or any other specific shape except that it must generally comprise an aperture oriented generally perpendicular to the plane that defines the back face 22 of the accessory, which allows for a clothing hanger hook to be inserted into and through it until the clothing hanger accessory engages the clothing support members at the base of the hook, such that the plane defined by the back face 22 is generally parallel to the plane defined by the clothing hanger hook 32. The embodiment shown in FIGS. 1-4 comprises a loop that is arched or generally semicircular in shape, but again, this is not limiting to the invention in its broadest respect.

Figure 2:
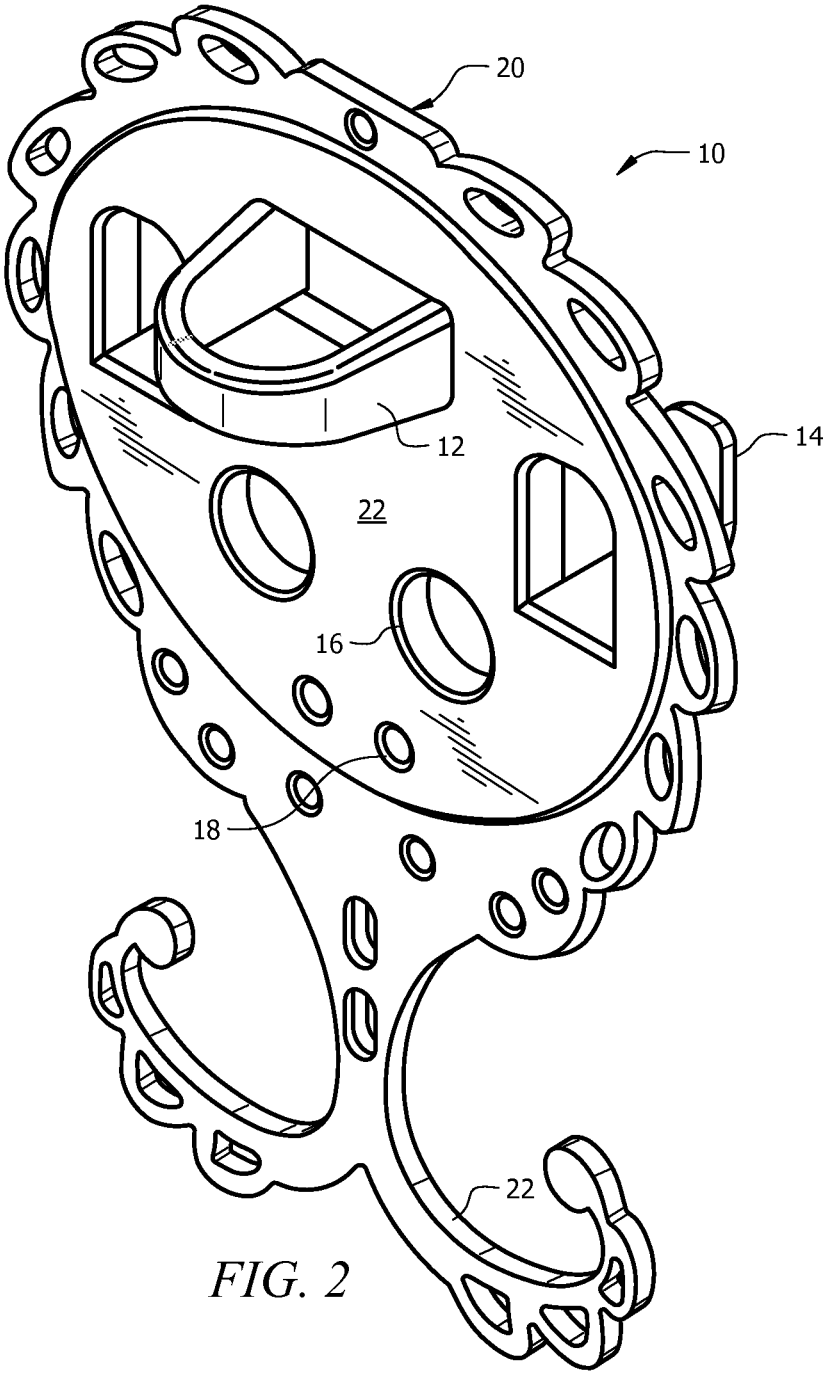
FIG. 2 illustrates a back perspective view of one embodiment of the clothing hanger accessory of the present invention.

FIG. 2 is a perspective view primarily of the back side 22 of one embodiment of the clothing hanger accessory of the present invention, without a clothing hanger. As depicted therein, the clothing hanger accessory 10 comprises a back face 22, a loop 12 extending approximately perpendicularly from the back face 22, a first set of two apertures 16 extending from the back face 22 to the front face 20 having a first diameter, a second set of two apertures 18 extending from the back face 22 to the front face 20 having a second diameter, wherein the first diameter is larger than the second diameter, and at least two hooks 22 extending downward.

Figure 1:
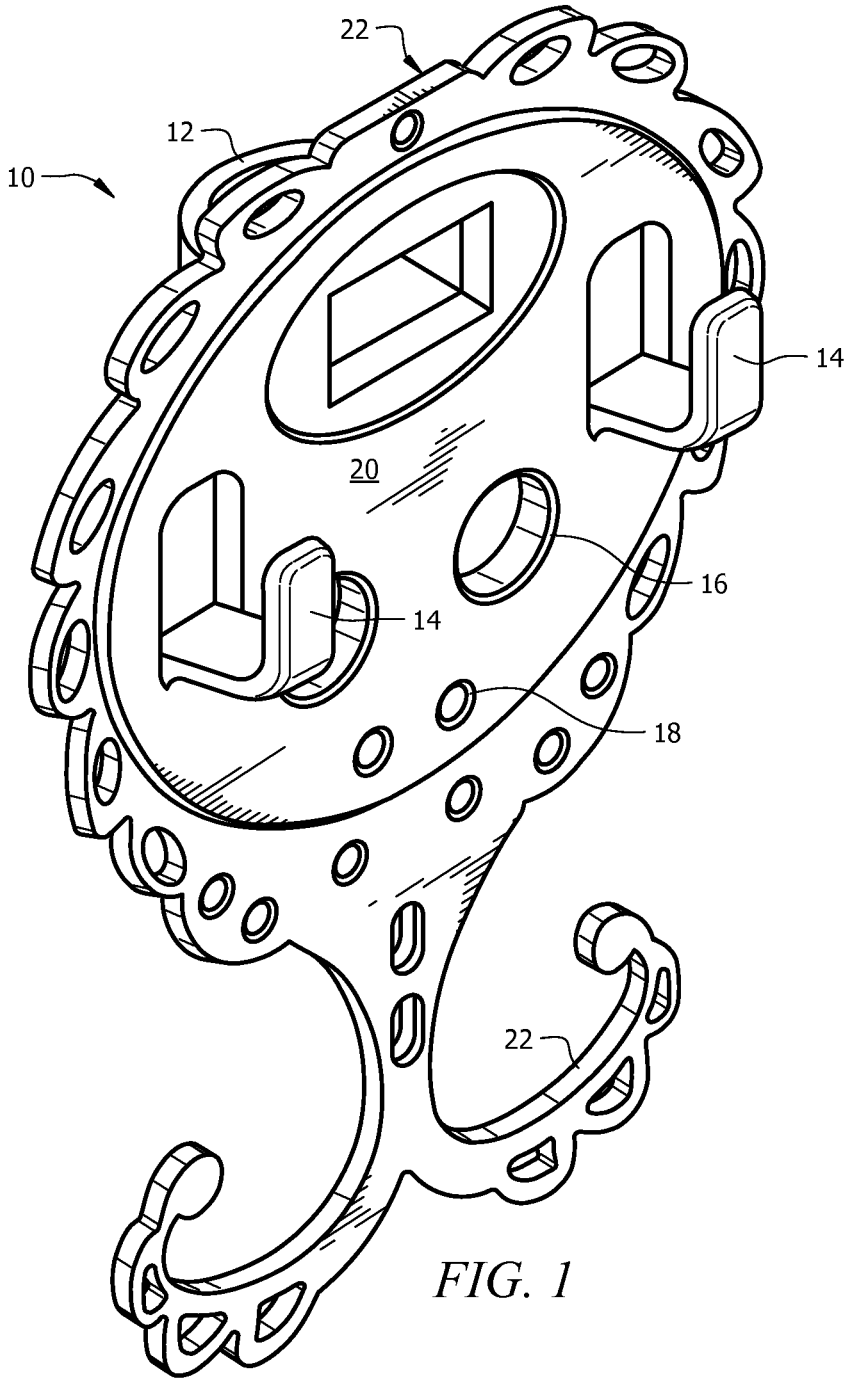
FIG. 1 illustrates a front perspective view of one embodiment of the clothing hanger accessory of the present invention.

FIG. 1 depicts a perspective view primarily of the front side 20 of one embodiment of the clothing hanger accessory of the present invention, without a clothing hanger. The features described above with respect to FIG. 2 are all shown in FIG. 1 as well. FIG. 1 also more clearly depicts two support members 14 that extend outwardly from the front face 20 of the clothing hanger accessory 10. Each support member 14 comprises a first portion that is approximately perpendicular to the front face 20, and a second portion that is approximately parallel to the front face 20. It is also seen in FIGS. 1 and 2 that hooks 22 define a plane that is approximately parallel to the plane defined by the front face 20 and back face 22.

Figure 4:
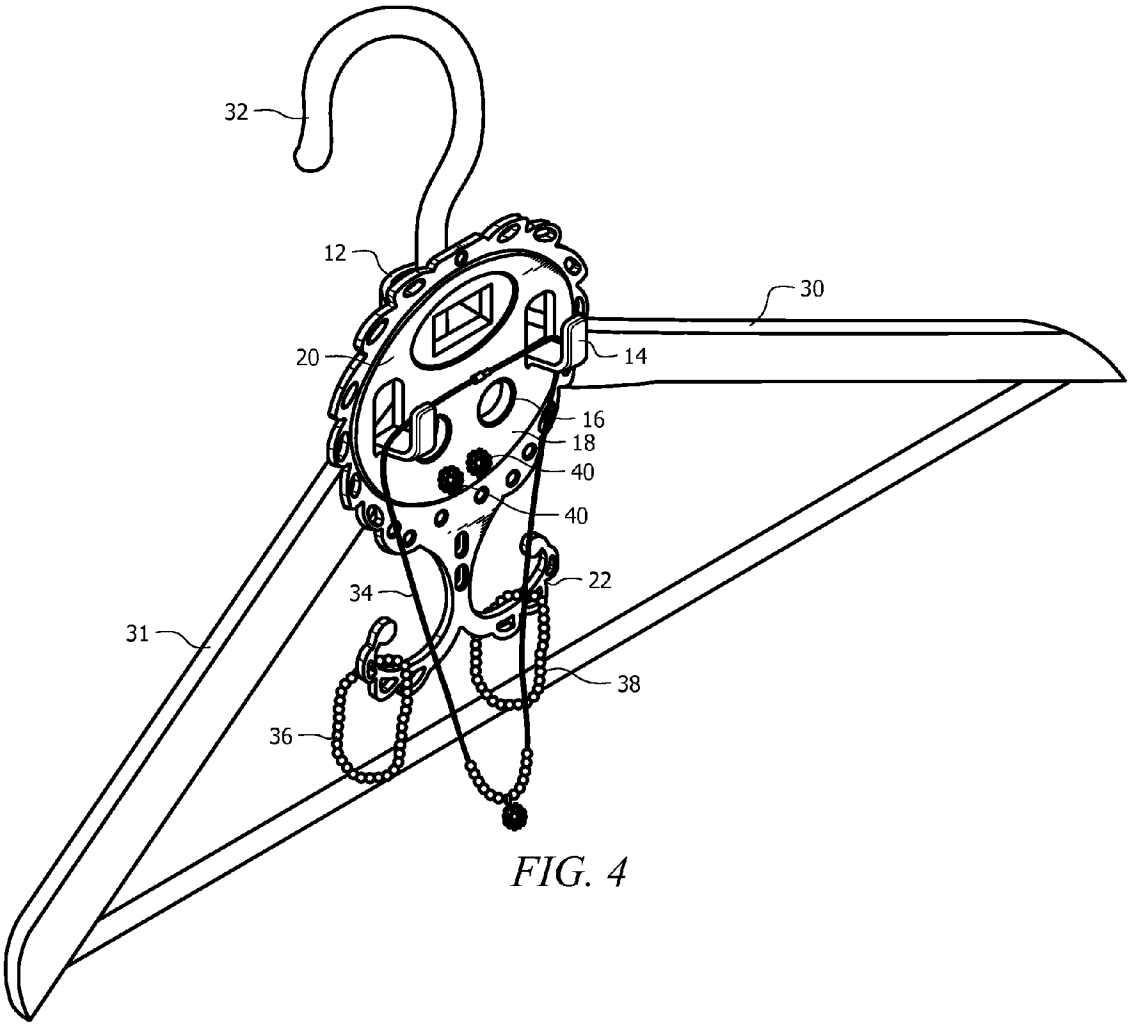
FIG. 4 illustrates a front perspective view of the clothing hanger accessory of the present invention being used to display various clothing accessories.

Referring now to FIG. 4, therein is depicted one embodiment of the clothing hanger accessory 10 of the present invention being used in conjunction with a clothing hanger to display certain clothing accessories. For example, a necklace 34 is depicted as hanging from support members 14. Earrings 40 are depicted being displayed by attaching them to the accessory 10 using the second set of apertures 18. Bracelets 36 and 38 are depicted hanging from hooks 22 that extend from the bottom of the accessory 10. The larger diameter apertures 16 can be used to store various items, such as hoop earrings (not shown), which are more easily attached to the clothing hanger accessory by larger diameter apertures 16.

All of the figures also depict the clothing hanger accessory as having a plurality of apertures positioned around the periphery of the device. These apertures can be used for various purposes, including storage of additional ear rings, or other sundry items such as charms or motivational quotes in order to allow the user to personalize the clothing hanger accessory as desired.

As shown in FIG. 4, the clothing hanger accessory of the present invention can be used to organize specific outfits of clothing. A specific outfit would include clothing accessories, such as necklaces, bracelets, earrings, finger rings, headbands, wristbands, scrunchies, other hair accessories, bangles, etc., that are intended to be worn with the specific articles of clothing stored on the hanger (not shown in the Figures for clarity), such as shirts, pants, blouses, etc. Therefore, the clothing hanger accessory of the present invention has several useful purposes.

First, the clothing hanger accessory of the present invention could be used in a retail setting to allow a retailer to quickly and easily display a complete clothing outfit package for purchase by a consumer. The invention could thereby increase sales by making the entire outfit purchase an easier proposition than possible with prior art clothing hangers.

Second, the clothing hanger accessory of the present invention could be used by consumers at their home or while traveling to organize specific outfits to be worn at a future time. Again, each accessory would allow the consumer to store one complete outfit all together on the same clothing hanger, including all clothing accessories intended to be worn with the outfit. The accessory would be useful in the home by allowing the user to more easily and quickly decide on what to wear that day. It would also be beneficial as a travel accessory when used as part of a garment bag.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

What is claimed is:

1. A clothing hanger accessory comprising:

a front face defining a first plane and a back face defining a second plane which is approximately parallel with the first plane;

a loop extending approximately perpendicularly from the back face, wherein an aperture defined by the loop defines a horizontal plane;

a first set of apertures extending from the front face to the back face with each aperture of the first set having a first diameter, wherein each of the first set of apertures define a first horizontal line that is parallel to the horizontal plane;

a second set of apertures extending from the front face to the back face with each aperture of the second set having a second diameter, wherein the first diameter is larger than the second diameter, wherein each of the second set of apertures define a second horizontal line that is parallel to the horizontal plane;

at least two support members extending from the front face, wherein each support member comprises a first portion that is approximately perpendicular to the front face and a second portion that is approximately parallel with the front face;

at least two hooks extending from a bottom end of the clothing hanger accessory, wherein the at least two hooks define a plane that is approximately parallel with the front face and the back face.

2. The clothing hanger accessory of claim 1 wherein the first set of apertures is positioned between the support members and the second set of apertures.

3. The clothing hanger accessory of claim 1 wherein the second set of apertures is positioned between the first set of apertures and the at least two hooks.

4. The clothing hanger accessory of claim 1 further comprising a plurality of apertures positioned around a periphery of the accessory.

5. The clothing hanger accessory of claim 1 wherein the loop is sized to receive a clothing hanger hook inserted into and through the loop, and wherein the loop is configured to engage the clothing hanger hook at its base from which at least two clothing support members extend when the clothing hanger accessory is in the installed configuration.

* * * * *